US011787675B2

(12) United States Patent
Xu et al.

(10) Patent No.: US 11,787,675 B2
(45) Date of Patent: Oct. 17, 2023

(54) SCISSOR AERIAL WORK PLATFORM AND SCISSOR LIFTING ASSEMBLY THEREOF

(71) Applicant: ZHEJIANG DINGLI MACHINERY CO., LTD., Huzhou (CN)

(72) Inventors: Zhong Xu, Huzhou (CN); Shugen Xu, Huzhou (CN)

(73) Assignee: ZHEJIANG DINGLI MACHINERY CO., LTD., Huzhou (CN)

( * ) Notice: Subject to any disclaimer, the term of this patent is extended or adjusted under 35 U.S.C. 154(b) by 0 days.

(21) Appl. No.: 17/898,906

(22) Filed: Aug. 30, 2022

(65) Prior Publication Data

US 2023/0286786 A1 Sep. 14, 2023

(30) Foreign Application Priority Data

Mar. 10, 2022 (CN) ..... 202210229534.6

(51) Int. Cl.
*B66F 7/06* (2006.01)
*B66F 7/28* (2006.01)

(52) U.S. Cl.
CPC ..... *B66F 7/0666* (2013.01); *B66F 7/28* (2013.01)

(58) Field of Classification Search
None
See application file for complete search history.

(56) References Cited

U.S. PATENT DOCUMENTS

2020/0317493 A1* 10/2020 Lombardo ..... B66F 11/042

FOREIGN PATENT DOCUMENTS

| | | | | |
|---|---|---|---|---|
| CN | 109573880 A | * | 4/2019 | ..... B65G 47/74 |
| CN | 113683014 A | * | 11/2021 | |
| EP | 1186568 A1 | * | 3/2002 | ..... B66F 11/042 |
| EP | 1396468 A1 | * | 3/2004 | ..... B66F 17/006 |
| JP | 05004798 A | * | 1/1993 | |
| JP | 06286998 A | * | 10/1994 | |

OTHER PUBLICATIONS

Machine Translation of JP 05-004798.*

* cited by examiner

*Primary Examiner* — Diem M Tran
(74) *Attorney, Agent, or Firm* — Olive Law Group, PLLC

(57) ABSTRACT

The present disclosure relates to the technical field of aerial work machines, in particular to a scissor aerial work platform and a scissor lifting assembly thereof. The scissor lifting assembly includes a scissor frame, a lifting mechanism and a weighing mechanism. A rotary connecting rod transversely penetrates through the scissor frame, and can rotate around its central axis; the lifting mechanism includes a drive base and a push rod extending out of the drive base; a lower end of the drive base is rotationally connected with the scissor frame, and a rotary sleeve is fixed to an extending-out top end of the push rod and fixed to a periphery of the rotary connecting rod in a sleeving manner; and the weighing mechanism is arranged on the rotary sleeve and the rotary connecting rod, and can measure a bearing capacity of the rotary connecting rod.

9 Claims, 6 Drawing Sheets

SCISSOR AERIAL WORK PLATFORM AND SCISSOR LIFTING ASSEMBLY THEREOF

CROSS REFERENCE TO RELATED APPLICATION

This application claims priority to and the benefit of Chinese Patent Application No. 2022102295346, filed on Mar. 10, 2022, the disclosure of which is incorporated by reference herein in its entirety.

TECHNICAL FIELD

The present disclosure relates to the technical field of mechanical equipment for aerial works, in particular to a scissor aerial work platform and a scissor lifting assembly thereof.

BACKGROUND ART

An aerial work platform is a product serving mobile aerial works such as aerial works, equipment installation and overhauls of various industries. Related products of the aerial work platform mainly include a scissor aerial work platform, a vehicle-mounted aerial work platform, a crank-propelled aerial work platform, a self-propelled aerial work platform, an aluminum alloy aerial work platform and a cylinder-sleeving-type aerial work platform. The scissor aerial work platform usually includes a base, a wheel assembly is arranged at a bottom of the base, a lifting mechanism is arranged on the base, and a work platform is arranged on the lifting mechanism, wherein the lifting mechanism is mostly driven by a hydraulic cylinder. A hydraulic system can well control and transmit power for lifting movement through the matching of hydraulic oil and the hydraulic cylinder; frequent steering is supported; and good safety performance and an overload protection function are achieved. But the hydraulic system is not suitable for being used on high-temperature and fire-prone occasions, is high in price and maintenance cost, and has large energy losses during transmission due to excess energy conversion links; and oil leakage of the hydraulic system frequently occurs, resulting in pollution to workplaces, so the hydraulic system cannot adapt to production workshops with high cleanliness requirements. In order to solve the above problems, there is an aerial work platform with an electric push rod replacing the hydraulic system on the market, such as an electric lift mechanism for scissor work platforms disclosed by Chinese patent with an application number of 201210286942.1. The electric lift mechanism comprises a scissor assembly and a power driver for controlling the opening and closing of each layer of component of the scissor assembly, the scissor assembly includes a top scissor component, a middle scissor component and a bottom scissor component, the inner arm and the outer arm of each scissor component are movably articulated with a crossed arm pin shaft, both the upper and the lower layers of scissor components are movably articulated with the crossed arm pin shafts, and the power driver is the electric push rod. By using the electric push rod as a lifting power device, the present disclosure avoids influences of leakage resulting from the hydraulic system on whole machines and environments, so as to further widen an application range of a lifting platform. But the electric push rod in the present disclosure does not have the overload protection function, and may be damaged once overload occurs.

SUMMARY

The present disclosure makes an improvement in order to solve the problems in the prior art, that is, a technical problem to be solved by the present disclosure is to provide a scissor lifting assembly, including a scissor frame, a lifting mechanism and a weighing mechanism. A rotary connecting rod transversely penetrates through the scissor frame, and can rotate around its central axis relative to the scissor frame; the lifting mechanism includes a drive base, a transmission device located in the drive base, a push rod with a bottom end connected with the transmission device and an extending-out top end extending out of the drive base, and a drive motor for supplying power to the transmission device; a lower end of the drive base is rotationally connected with the scissor frame, and a rotary sleeve is fixed to the extending-out top end of the push rod and fixed to a periphery of the rotary connecting rod in a sleeving manner; and the weighing mechanism is arranged on the rotary sleeve and the rotary connecting rod, and can measure a bearing capacity of the rotary connecting rod.

As a preference of the present disclosure, the weighing mechanism includes a stress pin shaft inserted into the rotary connecting rod and the rotary sleeve.

As a preference of the present disclosure, the scissor lifting assembly further includes a tilt angle sensor and an overload protection device; the scissor frame includes a plurality of scissor support links, and the tilt angle sensor can detect an included angle between any one scissor support link and a horizontal plane; and the overload protection device is in signal connection with the weighing mechanism and the tilt angle sensor, and the overload protection device is in signal connection with the drive motor, and can control the drive motor to stop running.

As a preference of the present disclosure, the lifting mechanism further includes an electromagnetic brake, and the electromagnetic brake can brake the drive motor, and is provided with a manual release switch.

As a preference of the present disclosure, the lifting mechanism further includes a speed reducer connected between the drive motor and the transmission device, and the push rod retracts into the drive base so as to drive the drive motor to reversely rotate to recover energy.

As a preference of the present disclosure, the lifting mechanism further includes a centrifugal brake, and the centrifugal brake can make a rotating speed of the drive motor reduced when the speed is above a safe limit in the push rod during retraction.

As a preference of the present disclosure, the transmission device is a ball screw structure, and includes a screw and a ball nut, and the ball nut is fixedly connected with the bottom end of the push rod.

As a preference of the present disclosure, a safety nut is arranged in the ball screw structure, is sleeved on the screw, and is fixedly connected with the ball nut, and arc-shaped convex parts capable of being embedded into spiral chutes of the screw are arranged on the safety nut.

As a preference of the present disclosure, the scissor frame includes a plurality of vertically-articulated scissor groups, and the lifting mechanism acts on two scissor groups separated by one scissor group through upper and lower ends.

A scissor aerial work platform, includes the scissor lifting assembly and further includes a work platform arranged on the scissor frame and a traveling chassis for installing a lower end of the scissor frame.

Beneficial Effects

Due to the weighing mechanism, the bearing capacity of the rotary connecting rod can be measured, and in actual application, a manufacturer determines the maximum bearing capacity of one rotary connecting rod, which corresponds to the maximum bearing capacity of the scissor frame; and the weighing mechanism can make a user see whether the actually-measured bearing capacity exceeds the maximum bearing capacity stipulated by the manufacturer in manners such as external connection with a measured value display screen, so as to avoid equipment damage and safety accidents caused by overloads.

Figure 1:
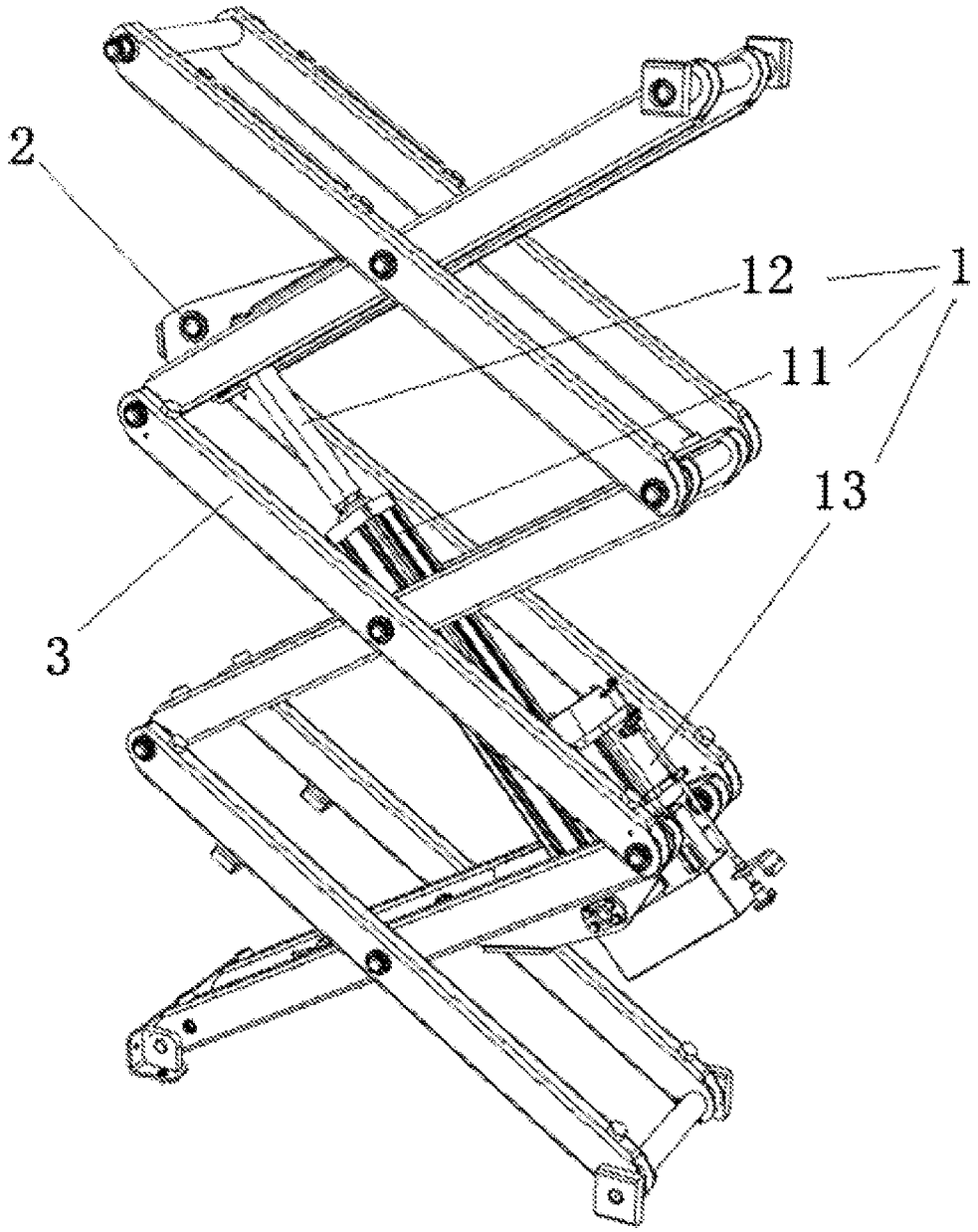
FIG. 1 is a structural schematic diagram of a scissor lifting assembly.
Figure 2:
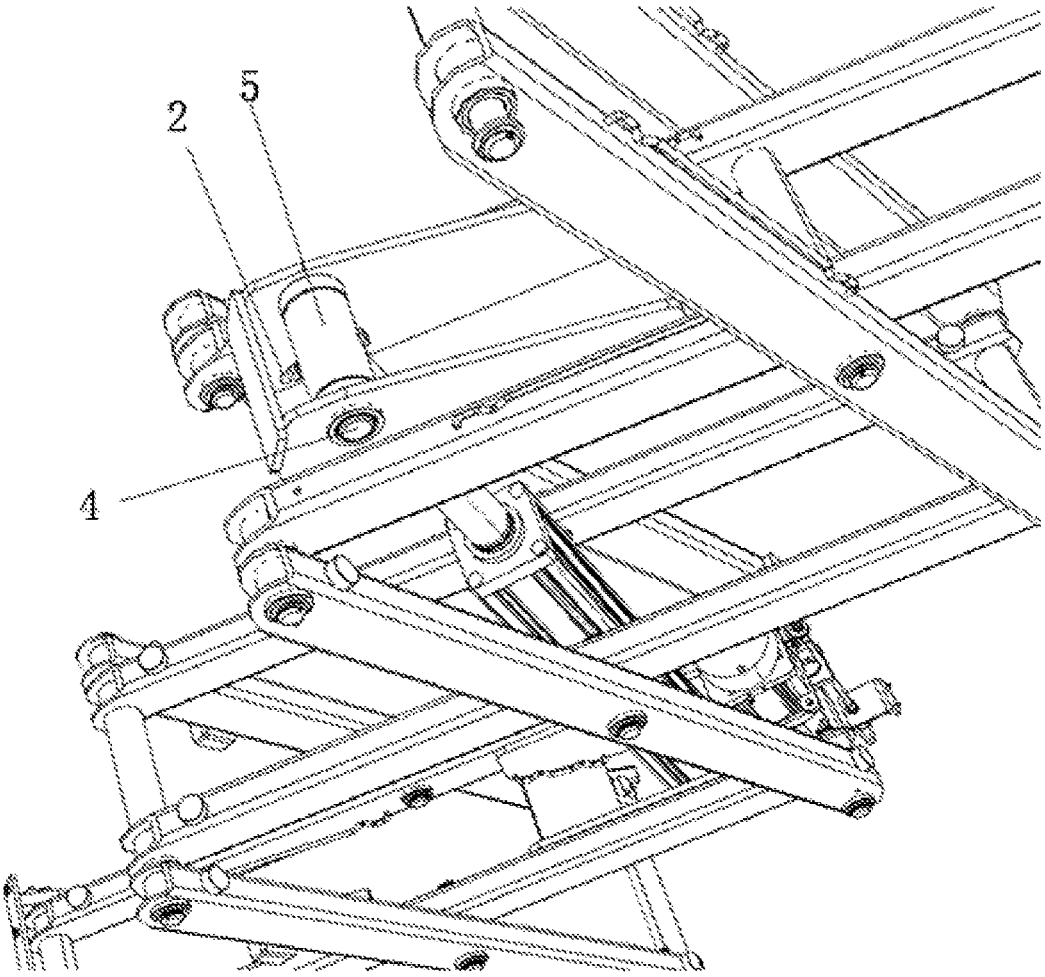
FIG. 2 is a schematic diagram of an installation relationship of a weighing mechanism, a rotary connecting rod and a rotary sleeve.
Figure 3:
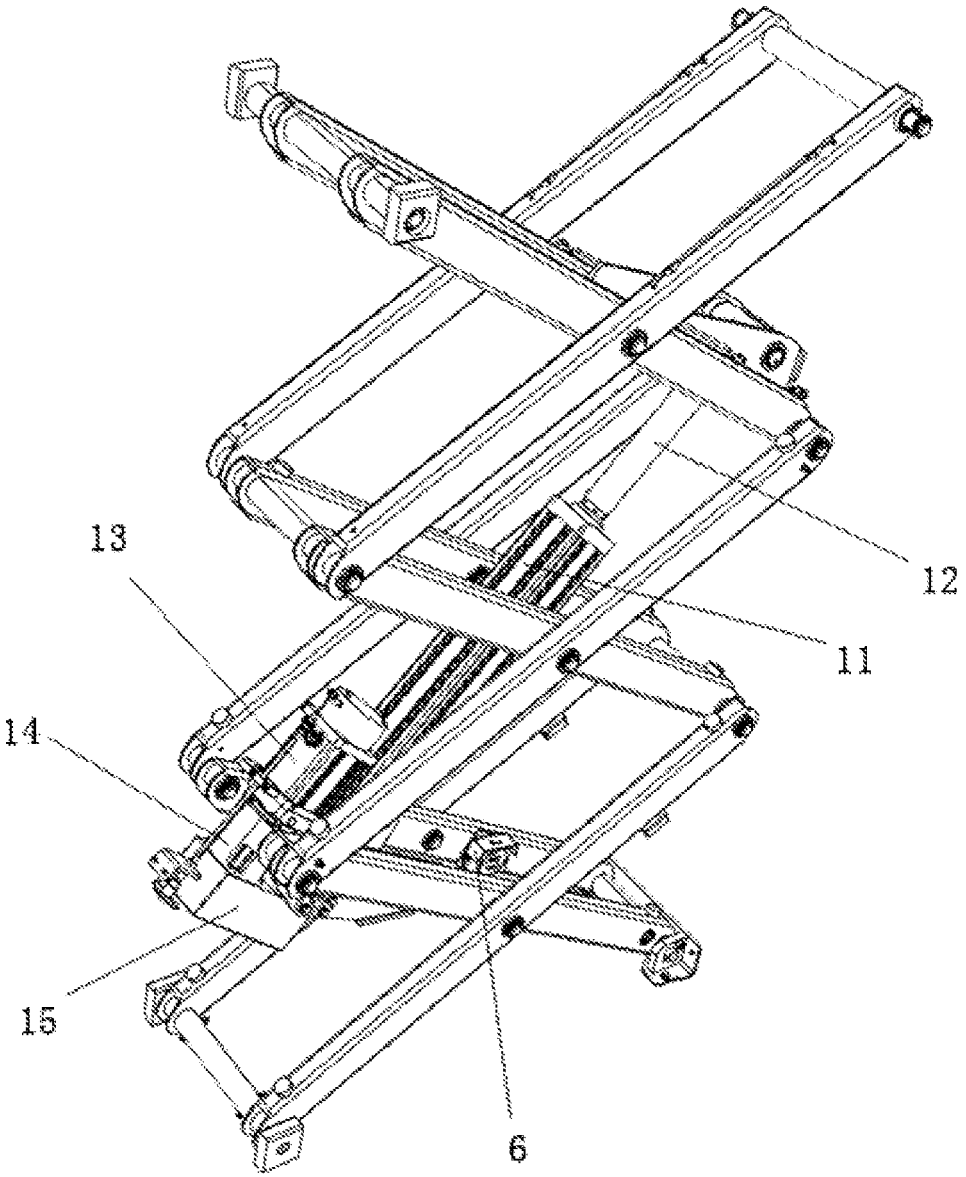
FIG. 3 is a structural schematic diagram of a lifting mechanism.
Figure 4:
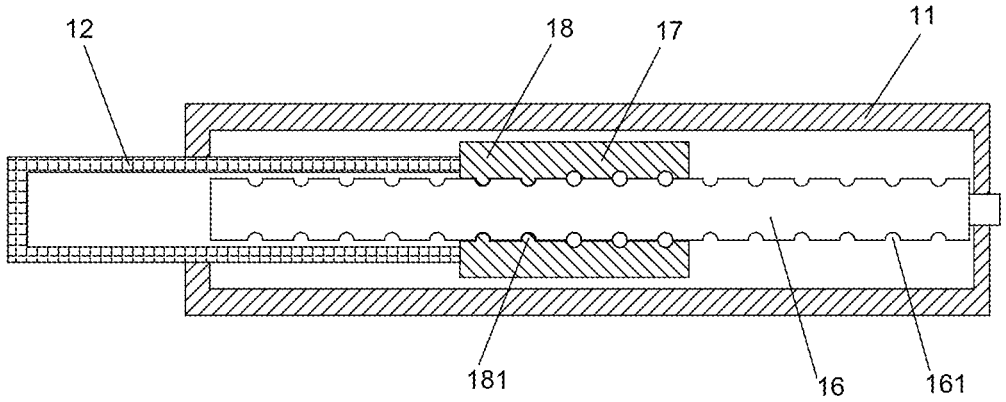
FIG. 4 is a structural schematic diagram of a transmission device.
Figure 5:
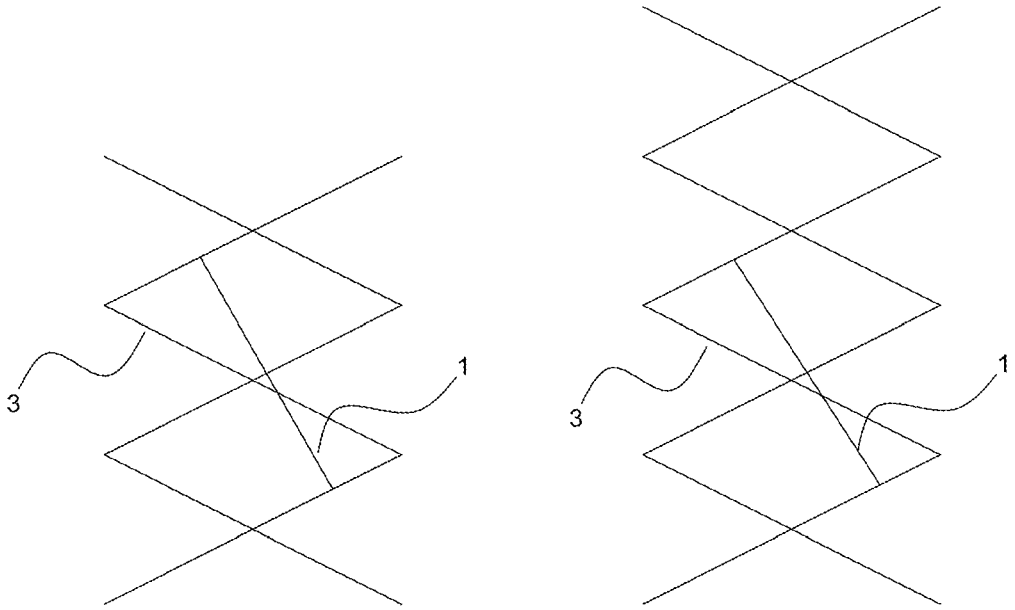
FIG. 5 is a schematic diagram of an installation position of a lifting mechanism when a scissor frame is provided with three or four scissor groups.
Figure 6:
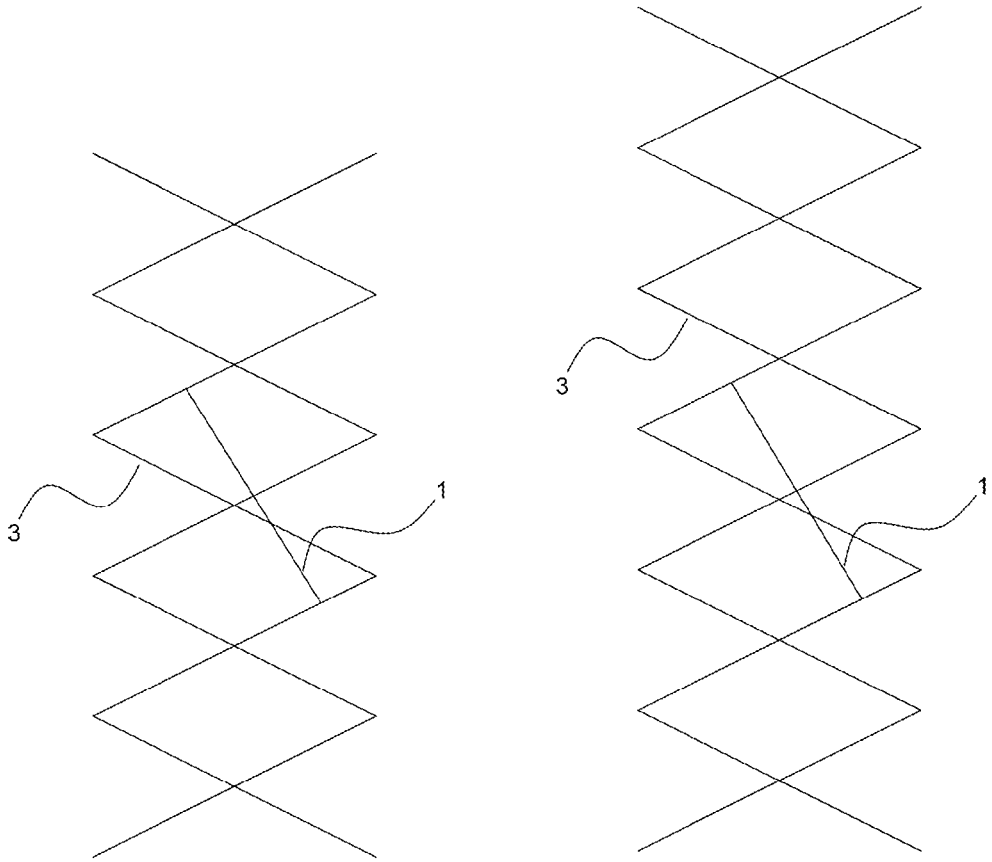
FIG. 6 is a schematic diagram of an installation position of a lifting mechanism when a scissor frame is provided with five or six scissor groups.
Figure 7:
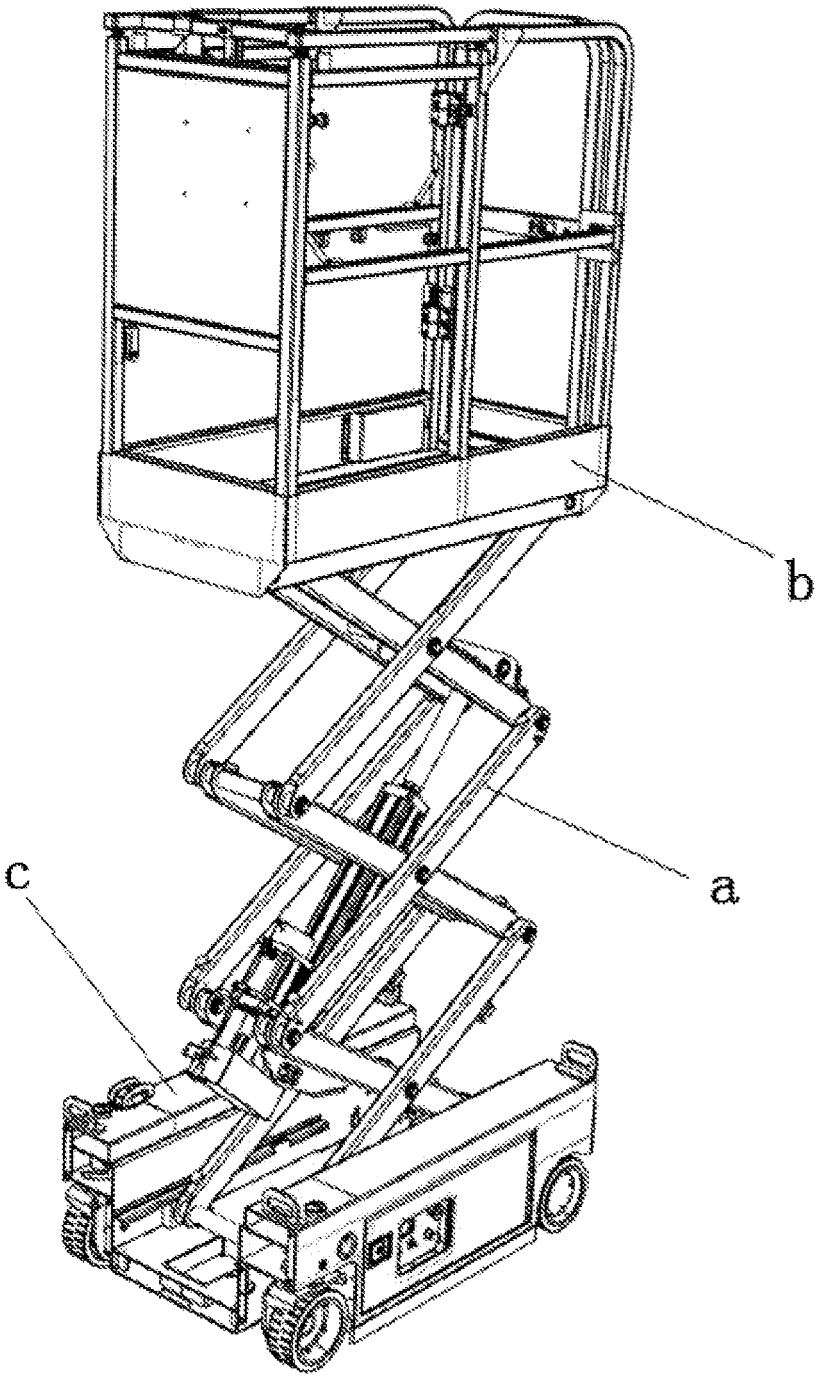
FIG. 7 is a schematic diagram of an overall structure of a scissor aerial work platform.

In the drawings: 1. Lifting mechanism, 2. Weighing mechanism, 3. scissor frame, 4. Rotary connecting rod, 5. Rotary sleeve, 6. Tile angle sensor, 11. Drive base, 12. Push rod, 13. Drive motor, 14. Electromagnetic brake, 15. Speed reducer, 16. Screw, 17. Ball nut, 18. Safety nut, 161. Spiral chute, and 181. Arc-shaped convex part.

DETAILED DESCRIPTION OF THE EMBODIMENTS

The following specific embodiments are only intended to explain the present disclosure instead of limiting it, those skilled in the art can make modifications to the embodiments without creative contributions according to requirements after reading the specification, but the modifications are protected by patent laws as long as they fall within the scope of claims of the present disclosure.

A scissor lifting assembly a of the present disclosure, includes a scissor frame 3, a lifting mechanism 1 and a weighing mechanism 2. A rotary connecting rod 4 transversely penetrates through the scissor frame 3, and can rotate around its central axis relative to the scissor frame 3, and the rotary connecting rod 4 is connected with the scissor frame 3 through bearings, so that the rotary connecting rod 4 can rotate. The lifting mechanism 1 is provided with an electric push rod 12 rather than a hydraulic system, so as to achieve the effects of being clean and efficient. Specifically, the lifting mechanism 1 includes a drive base 11, a transmission device located in the drive base 11, the push rod 12 with a bottom end connected with the transmission device and an extending-out top end extending out of the drive base 11, and a drive motor 13 for supplying power to the transmission device. During use, the drive motor 13 is started to drive the transmission device to run, and the push rod 12 is driven to extend outwards or retract; and the scissor frame 3 is pushed to unfold when the push rod 12 extends out, and the scissor frame 3 is pulled to fold when the push rod 12 retracts. When the push rod 12 drives the scissor frame 3 to unfold or fold, a tilt degree of the push rod 12 is changed all the time, so a lower end of the drive base 11 is rotationally connected with the scissor frame 3. The extending-out top end of the push rod 12 needs to rotate relative to the scissor frame 3 while supporting the rotary connecting rod 4. In the embodiment, preferably, a rotary sleeve 5 is fixed to the extending-out top end of the push rod 12 and fixed to a periphery of the rotary connecting rod 4 in a sleeving manner, and the rotary sleeve 5 and the rotary connecting rod 4 synchronously rotate relative to the scissor frame 3. In the embodiment, the weighing mechanism 2 is arranged on the rotary sleeve 5 and the rotary connecting rod 4 to measure a bearing capacity of the rotary connecting rod 4, a strain gauge may be arranged between the rotary sleeve 5 and the rotary connecting rod 4, and as the rotary sleeve 5 and the rotary connecting rod 4 are kept relatively static, relatively static states between the strain gauge and the rotary sleeve 5 and between the strain gauge and the rotary connecting rod 4 are also kept, so as to ensure measurement accuracy of the strain gauge. Due to the weighing mechanism 2, the bearing capacity of the rotary connecting rod 4 can be measured. In actual application, a manufacturer determines the maximum bearing capacity of the rotary connecting rod 4, which corresponds to the maximum bearing capacity of the scissor frame 3. The weighing mechanism 2 can make a user see whether the actually-measured bearing capacity exceeds the maximum bearing capacity stipulated by the manufacturer in manners such as external connection with a measured value display screen, so as to avoid equipment damage and safety accidents caused by overloads. Furthermore, preferably, the weighing mechanism 2 includes a stress pin shaft inserted into the rotary connecting rod 4 and the rotary sleeve 5, and installation holes allowing the stress pin shaft to be inserted therein need to formed in the rotary connecting rod 4 and the rotary sleeve 5. The stress pin shaft not only has a weighing effect, but also has the effect of fixing the rotary connecting rod 4 and the rotary sleeve 5, so as to keep the rotary connecting rod 4 and the rotary sleeve 5 relatively static. As a result, the rotary connecting rod 4 and the rotary sleeve 5 are unnecessary to be fixedly connected additionally, it is only necessary to sleeve the rotary connecting rod 4 with the rotary sleeve 5, and an additional fixed connection structure is omitted, so that installation is convenient and cost is reduced.

When the scissor frame 3 gradually extends to unfold and retracts to fold, and as a tilt angle of the push rod 12 in the lifting mechanism 1 is changed and tilt angles of scissor support links in the scissor frame 3 are also changed, the actual maximum bearing capacity of the scissor frame 3 will also be changed accordingly. Experimental data show that when the scissor frame 3 gradually extends to unfold from an initial folded state, the maximum bearing capacity of the scissor frame 3 is reduced gradually first, and then gradually increased. In this way, whether overload occurs needs to be manually judged at every moment at which the scissor frame 3 unfolds, and apparently judgment precision is hardly achieved manually, which is achieved by the introduction of a control system. Thus, in the embodiment, preferably, the scissor lifting assembly a further includes a tilt angle sensor 6 and an overload protection device. The scissor frame 3 includes a plurality of scissor support links. The tilt angle sensor 6 can detect an included angle between any one scissor support link and a horizontal plane, and a height to which a highest point of the scissor frame 3 is accessible is calculated by measuring the included angle. The overload protection device is in signal connection with the weighing mechanism 2 and the tilt angle sensor 6, a program controller is arranged in the overload protection device, the maximum bearing capacity corresponding to states that the scissor frame 3 unfolds to different degrees is written into the program controller through a program, the weighing mechanism 2 transmits a weight value measured in real time to the program controller, and the program controller compares the value with a standard maximum bearing capacity at this moment. If the value does not exceed the standard maximum bearing capacity, normal running is achieved, and if the value exceeds the standard maximum bearing capacity, the overload protection device is in signal connection with the drive motor 13, and controls the drive motor 13 to stop running. As the maximum bearing capacity of the scissor frame 3 is gradually reduced first during lifting, the scissor frame 3 tends to overload with the elevation of a lifting height when lifting goods; and with the above solutions, overloads can be avoided effectively during lifting, equipment damage can be avoided, potential safety hazards can be eliminated, and precision and high efficiency are achieved due to a program control manner.

If braking is performed only through the shutdown of the drive motor 13, the drive motor 13 needs to bear high pressure, resulting in easiness in damage to the drive motor 13, and a poor braking effect of the drive motor. In the embodiment, preferably, the lifting mechanism 1 further includes an electromagnetic brake 14, and the electromagnetic brake 14 can brake the drive motor 13 when powered off, and does not act on the drive motor 13 when powered on. Furthermore, the overload protection device is in signal connection with the electromagnetic brake 14, and when braking is needed due to overloads, the overload protection device controls the electromagnetic brake 14 to be powered off through an instruction to brake the drive motor 13. In actual application, when the scissor frame 3 needs to stop after unfolding to a certain degree, it can also be braked by the electromagnetic brake 14, so that the scissor frame 3 is stably kept at a specific height. The electromagnetic brake 14 is further provided with a manual release switch, once there is a problem with a worker on a work platform b lifted by the scissor frame 3, or the electromagnetic brake 14 cannot be loosened due to insufficient electric quantity of an electromagnetic switch of the electromagnetic brake 14, the manual release switch can be timely used for terminating braking of the electromagnetic brake 14 for the drive motor 13, and the scissor frame 3 folds downwards for retracting, so as to avoid safety accidents. The lifting mechanism 1 further includes a speed reducer 15 connected between the drive motor 13 and the transmission device, when a reduction ratio of the speed reducer 15 is large, a reverse rotation speed of the drive motor 13 is low through pressing under the gravity of the work platform b and goods above the scissor frame 3, and even the drive motor 13 needs to be started to reversely rotate to accelerate retraction of the scissor frame 3. When the reduction ratio of the speed reducer 15 is small, the drive motor is easily driven by the pressing under the gravity of the work platform b and the goods above the scissor frame 3 to reversely rotate, the scissor frame 3 quickly retracts, and the drive motor 13 is driven to reversely rotate so as to recover energy, thereby achieving the effect of energy conservation. Thus, in the embodiment, preferably, the reduction ratio of the speed reducer 15 adopts a large numerical ratio. But when the above solution that the drive motor 13 can recover energy is adopted, a falling speed of the work platform b above the scissor frame 3 is high, and once it exceeds a safe limit, personal safety of the worker standing on the work platform b may be endangered, or the goods on the work platform b may be damaged by strong impact at last. In order to avoid the above situation, in the embodiment, preferably, the lifting mechanism 1 further includes a centrifugal brake, and the centrifugal brake can make a rotating speed of the drive motor 13 reduced when the speed is above a safe limit in the push rod 12 during retraction, so as to ensure the safety of the worker and the goods on the work platform b.

The transmission device on the lifting mechanism 1 is preferably a ball screw structure, and includes a screw 16 and a ball nut 17, spiral chutes 161 allowing balls to roll are formed in the screw 16, and the drive motor 13 drives the screw 16 to rotate, so that the ball nut 17 moves along the screw 16; and a lower portion of the push rod 12 extends into the drive base 11, and the bottom end of the push rod is fixedly connected with the ball nut 17, so that the push rod 12 can move along with the ball nut 17. By the adoption of the ball screw structure, friction is small, running is stable, and transmission efficiency and precision are high; and compared with the hydraulic system, a failure rate is low, and repair and maintenance are easy and convenient. The bearing capacity depends on the quantity and sizes of the steel balls, and the two variables can be controlled according to actual demands. But in actual application, the balls may break or fall, resulting in dislocation of chutes, allowing the balls to roll, in the ball nut 17 and the spiral chutes 161 in the screw 16, affecting normal running of the ball nut 17, and reducing the precision of the ball nut; and there is also an error in measuring the stroke of the push rod 12, resulting in misjudgment resulting from the overload protection device in calculating whether overloads occur. In order to avoid the above situation, in the embodiment, preferably, a safety nut 18 is arranged in the ball screw structure, is sleeved on the screw 16, and is fixedly connected with the ball nut 17, and arc-shaped convex parts 181 capable of being embedded into the spiral chutes 161 of the screw 16 are arranged on the safety nut 18. When the ball nut 17 normally runs, the arc-shaped convex parts 181 on the safety nut 18 extend into the spiral chutes 161, but are not attached to bottom surfaces of the spiral chutes 161, so the safety nut 18 does not act. Once ball losses occur in the ball nut 17, the safety nut 18 clasps the screw 16, the arc-shaped convex parts 181 of the safety nut abut against the bottom surfaces of the spiral chutes 161, so as to achieve positioning, and the ball nut 17 is blocked to be prevented from being dislocated, thereby ensuring that the ball nut 17 can also normally run in the original precision. At this moment, large damping exists between the safety nut 18 and the screw 16, it can be known that the ball nut 17 breaks down when it is found that running of the push rod 12 obviously slows down, and it is necessary to maintain and replace the ball nut after use.

In a currently-common scissor lifting assembly driven by the hydraulic system, more than one hydraulic push rod may be arranged usually in order to achieve higher bearing capacity, for example, two hydraulic push rods are arranged commonly, strokes of the two hydraulic push rods need to be consistent under this condition, and synchronization can be achieved only by connecting hydraulic oil paths of the two hydraulic push rods. But in the embodiment, under the condition that the motor drives the push rod 12, synchronization is hardly ensured if the two push rods 12 are used, and it is necessary to accurately calculate installation positions of the two push rods 12 and a stroke ratio of the two push rods 12, which greatly increases manufacturing cost. Thus, in the embodiment, preferably, only one push rod 12 is adopted. Under the condition that only one push rod 12 is adopted, it is necessary to reasonably select an overall installation position of the lifting mechanism 1, especially positions of upper and lower installation points, so as to ensure stable supporting of the lifting mechanism 1 for the scissor frame 3 and ensure that the scissor frame 3 does not easily shake. The scissor frame 3 is formed by vertically hinging a plurality of scissor groups. The specification stipulates that scissor groups are counted from bottom to top, and the scissor group at the bottommost portion is a first scissor group; when there are many scissor groups, and if the supporting strength of the scissor frame 3 is improved by increasing spans of upper and lower ends of the lifting mechanism 1 in the scissor frame 3 by increasing a stroke of the lifting mechanism 1, the cost consumed in increasing the stroke of the lifting mechanism 1 is high, which is not a preferred solution. In the embodiment, preferably, the lifting mechanism 1 is erected on three continuous scissor groups, specifically, the lifting mechanism 1 acts on two scissor groups separated by one scissor group through the upper and the lower ends, so that the stroke of the lifting mechanism 1 is determined, and the cost is controlled. Thus, in the embodiment, the installation position of the lifting mechanism 1 needs to be adjusted under the condition that there are different numbers of scissor groups; when the scissor frame 3 is provided with three or four scissor groups, the lower end of the drive base 11 in the lifting mechanism 1 is rotationally connected with the first scissor group, and the extending-out top end of the push rod 12 is rotationally connected with the rotary connecting rod 4 installed on the third scissor group. When the scissor frame 3 is provided with five or six scissor groups, the lower end of the drive base 11 in the lifting mechanism 1 is rotationally connected with the second scissor group, and the extending-out top end of the push rod 12 is rotationally connected with the rotary connecting rod 4 installed on the fourth scissor group; and experiments show that it can be ensured that the scissor frame 3 is in a stable state by arranging the lifting mechanism 1 according to the above solution. In addition, the structural strength of the scissor frame can be improved by increasing the thickness of scissor support links of the scissor frame 3, so as to further improve the stability of the scissor frame 3.

Disclosed is a scissor aerial work platform, including a scissor lifting assembly a and further including a work platform b arranged on the scissor frame 3 and a traveling chassis c for installing a lower end of the scissor frame 3. The traveling chassis c includes a base and a steering system. The steering system includes left and right steering wheel assemblies and a steering control mechanism. The steering control mechanism includes a linkage frame transversely erected between the left and the right steering wheel assemblies and an electric push rod device. The electric push rod device includes a power seat and a steering transmission rod extending out of the power seat, one end, away from the steering transmission rod, of the power seat is rotationally connected to the base, and an extending-out end of the steering transmission rod is rotationally connected to the linkage frame. In the case of steering, the electric push rod device is started to make the steering transmission rod extend out or retract, so as to drive the linkage frame to move, and then the left and the right steering wheel assemblies are simultaneously driven to steer.

The above descriptions are merely specific implementations of the present disclosure, which are not intended to limit the protection scope of the present disclosure. Any modification or replacement which is easily conceived by any person skilled in the art within the technical scope described in the present disclosure should fall within the scope of protection the present disclosure. Therefore, the scope of protection of the present disclosure should follow the scope of protection of the claims.

What is claimed is:

1. A scissor lifting assembly, comprising a scissor frame, a lifting mechanism and a weighing mechanism, wherein a rotary connecting rod transversely penetrates through the scissor frame, and is capable to rotate around its central axis relative to the scissor frame; the lifting mechanism comprises a drive base, a transmission device located in the drive base, a push rod with a bottom end connected with the transmission device and an extending-out top end extending out of the drive base, and a drive motor configured for supplying power to the transmission device; a lower end of the drive base is rotationally connected with the scissor frame, and a rotary sleeve is fixed to the extending-out top end of the push rod and fixed to a periphery of the rotary connecting rod in a sleeving manner; and the weighing mechanism is arranged on the rotary sleeve and the rotary connecting rod, and is capable to measure a bearing capacity of the rotary connecting rod; and wherein the lifting mechanism further comprises an electromagnetic brake, and the electromagnetic brake is capable to brake the drive motor, and is provided with a manual release switch.

2. The scissor lifting assembly according to claim 1, wherein the weighing mechanism comprises a stress pin shaft inserted into the rotary connecting rod and the rotary sleeve.

3. The scissor lifting assembly according to claim 1, further comprising a tilt angle sensor and an overload protection device; the scissor frame comprises a plurality of scissor support links, and the tilt angle sensor is capable to detect an included angle between any one scissor support link and a horizontal plane; and the overload protection device is in signal connection with the weighing mechanism and the tilt angle sensor, and the overload protection device is in signal connection with the drive motor, and is capable to control the drive motor to stop running.

4. The scissor lifting assembly according to claim 1, wherein the lifting mechanism further comprises a speed reducer connected between the drive motor and the transmission device, and the push rod retracts into the drive base so as to drive the drive motor to reversely rotate for energy recovery.

5. The scissor lifting assembly according to claim 4, wherein the lifting mechanism further comprises a centrifugal brake, and the centrifugal brake is capable to make a rotating speed of the drive motor reduced when the rotating speed is above a safe limit in the push rod during retraction.

6. The scissor lifting assembly according to claim 1, wherein the transmission device is a ball screw structure, and comprises a screw and a ball nut, and the ball nut is fixedly connected with the bottom end of the push rod.

7. The scissor lifting assembly according to claim 6, wherein the ball screw structure is sleeved on the screw, and fixedly connected with the ball nut, and arc-shaped convex parts capable of being embedded into spiral chutes of the screw are arranged on the safety nut.

8. The scissor lifting assembly according to claim 1, wherein the scissor frame comprises a plurality of vertically-articulated scissor groups, and the lifting mechanism acts on two scissor groups separated by one scissor group through upper and lower ends.

9. A scissor aerial work platform, wherein it comprises the scissor lifting assembly according to claim 1 and further comprises a work platform arranged on the scissor frame and a traveling chassis for installing a lower end of the scissor frame.

* * * * *